United States Patent [19]

Moomey, Jr.

[11] 4,070,840

[45] Jan. 31, 1978

[54] SUSPENDED CEILING CONSTRUCTION

[75] Inventor: Henry E. Moomey, Jr., Grand Rapids, Mich.

[73] Assignees: James C. Shuster, Grand Rapids; William G. Brinks, Grandville, both of Mich. ; part interest to each

[21] Appl. No.: 737,782

[22] Filed: Nov. 1, 1976

Related U.S. Application Data

[63] Continuation-in-part of Ser. No. 546,309, Feb. 3, 1975, Pat. No. 3,988,871, which is a continuation-in-part of Ser. No. 407,802, Oct. 9, 1973, Pat. No. 3,863,413.

[51] Int. Cl.[2] ..... E04B 5/52

[52] U.S. Cl. ..... 52/489; 52/496

[58] Field of Search ..... 52/484, 496, 489

[56] References Cited

U.S. PATENT DOCUMENTS

| | | | |
|---|---|---|---|
| 3,589,086 | 6/1971 | Schilling | 52/484 X |
| 3,973,368 | 8/1976 | Moeller | 52/484 X |
| 3,988,871 | 11/1976 | Moomey | 52/484 |

*Primary Examiner*—Price C. Faw, Jr.
*Assistant Examiner*—Carl D. Friedman
*Attorney, Agent, or Firm*—Price, Heneveld, Huizenga & Cooper

[57] ABSTRACT

A suspended ceiling construction comprises a plurality of individual ceiling tiles suspended in rows between evenly spaced support beams. Each tile has a kerfed back edge that fits over a flange on a back support beam and an "L"-shaped front portion having a lower lip that fits under a flange on a front support beam. The side edges of each ceiling tile include longitudinal kerfs therein extending rearwardly from the front portion of the tile, with the kerfs being positioned above the lip on the front portion of the tile by a distance at least equal to the thickness of the flange on the front support beam. Interengaging splines fit into the kerfs in the sides of abutting ceiling tiles and at least one of the splines engages the front support beams. The splines are movable with respect to each other so a locking means associated with one of the splines can be positioned in a slot associated with a tile adjacent to the locking means to secure the tile in the ceiling; and the locking means can be positioned in a vertical access in communication with the slot to remove the tile from the ceiling.

15 Claims, 9 Drawing Figures

SUSPENDED CEILING CONSTRUCTION

CROSS REFERENCE TO RELATED APPLICATIONS

This application is a continuation-in-part of my copending U.S. patent application Ser. No. 546,309, filed Feb. 3, 1975, now U.S. Pat. No. 3,988,871, which, in turn, is a continuation-in-part of U.S. patent application Ser. No. 407,802, filed Oct. 9, 1973, now U.S. Pat. No. 3,863,413.

BACKGROUND OF THE INVENTION

1. Field of the Invention

This invention relates to a suspended ceiling construction. In one of its aspects the invention relates to a suspended ceiling construction having a concealed support structure and access tiles removable by sliding locking splines from locking to release position.

2. State of the Prior Art

Suspended ceilings are well known. In most typical suspended ceiling structures, evenly spaced suspension beams or support members are suspended from the ceiling or other structural members of the enclosure, and individual ceiling tiles of a given size are suspended between adjacent support members. The support members may be concealed or visible from a position below the ceiling structure, with the concealed support structures involving more complex structural problems than ceilings with visible supports.

Two of the most common types of suspended ceilings in use today are "T-Bar" and "Z-Bar" type structures. In a T-bar grid structure, the support structure comprises a rectangular grid or matrix of inverted T-shaped members or T-bars suspended from the ceiling. The T-bar structure may be visible or concealed, depending on the ceiling tiles mounted in the grid. A visible T-bar system is called a "conventional grid" system, while a concealed T-bar system is called a "concealed grid" system.

In a conventional grid system, individual ceiling tiles rest on the upper surfaces of the horizontal flanges of the T-bars. In this type of construction, access to the space above the ceiling is provided by lifting the tiles upwardly out of the gridwork.

One problem with this type of system is that the flanges on the T-bars are fully visible from below the ceiling, thus impairing the aesthetic qualties of the ceiling and making it necessary to employ finished metal in the T-bars so that the visible portions will be as unobtrusive as possible.

Another problem with a conventional grid system is that the ceiling tiles must be lifted upwardly to gain access to the space above the suspended ceiling. This upward removal requires extra clearance between the suspended ceiling and any structure or ductwork above the suspended ceiling. Three inches of clearance may be necessary for reasonable access. In cases where this extra clearance is not possible or is omitted through poor installation procedures, it is quite difficult to gain access to the space above the tiles.

In concealed grid T-bar structures, the tiles have a kerf in the outside edges thereof and the tiles are fitted over the edges of the horizontal flanges on the T-bars. The grid members are concealed with this type of system, but the tiles are not removable and must be broken to gain access to the space above ths suspended ceiling.

In a Z-bar type of structure, the support structure for the suspended ceiling is formed of evenly spaced parallel support members called Z-bars, which typically are suspended from C-shaped channel members (typically $1\frac{1}{2}$ inch channel members) that are spaced evenly across the entire width of a room and run in a perpendicular direction with respect to the Z-bars. The channel members are suspended from the ceiling by suspension wire, and the Z-bars are suspended from the channel members by spring wire clips. The Z-bars are similar in cross-sectional configuration to the T-bars of a concealed grid structure in that the Z-bars have a vertical support member with horizontal flanges extending outwardly from the bottom in an inverted T-shaped member. However, the Z-bars also have a horizontal flange extending outwardly from the top of the vertical support member, thus giving the member a roughly Z-shaped cross section. The flange at the top is designed to engage spring clips that hold the Z-bar to the transverse channel members.

The ceiling tiles conventionally employed in a Z-bar structure are twelve inch square tiles, with each tile having a continuous kerf in the side running around the entire tile. The kerf on the back edge of the tile fits over a flange on a back Z-bar, and the kerf on the front edge of the tile fits over a flange on a Z-bar in front of the tile, with the front Z-bar being fitted into position after a row of tiles has been fitted into engagement with the flange on the back Z-bar. "Breather splines," or thin metal plates, are inserted in the kerfs in side edges of adjacent tiles, in order to close the slots between the tiles and eliminate air flow through the slots.

One of the principal advantages of Z-bar ceilings is that the support structure is completely invisible when the ceiling is installed, and this is a very desirable feature. Accordingly, this type of ceiling has been installed in a high percentage of suspended ceiling installations over the past few years.

One of the principal drawbacks with a Z-bar type of ceiling structure is that, like a concealed grid T-bar ceiling, once the ceiling is installed, the tiles are premanently locked in place, and there is not way to gain access to the space above the ceiling without breaking and destroying a number of tiles. Reassembly of the ceiling structure after access has been provided similarly is a difficult task. Since it is important in many installations that access be provided to the space above the suspended ceiling (e.g., for repair or maintenance of lights, air conditioning, electric wiring or other utilities), the inaccessability of Z-bar ceiling structure is a serious deficiency with this type of system.

In order to overcome the problems of inaccessability of suspended ceilings having a concealed support structure, some attempts have been made to design removable access tiles for existing concealed grid T-bar and Z-bar systems, and other attempts have been made to develop new types of ceilings having access tiles. The problems with the access tiles for ceilings having concealed grids have been that the access tiles have been too complex and have employed expensive and complicated clips for holding the tiles in place. In addition, even with workable access tiles, convenient access to the space above the ceiling is still limited to the space immediately above each access tile, and other tiles still have to be broken away to provide an enlarged access area or access to areas where special access tiles are not located.

One of the principal problems with other types of ceiling structures having access tiles is that they do not employ Z-bar ceiling or T-bar support structures but employ special ceiling supports designed especially for that particular ceiling. Hence, in the vast majority of existing installations, wherein Z-bar or T-bar support structures are already in use, it would be necessary to remove and discard the entire support structure in order to switch over to a new type of ceiling. Other problems with these other types of ceiling structures are that they frequently are difficult to install and remove.

The present invention obviates the foregoing deficiencies in the prior art and provides a simple and inexpensive suspended ceiling construction having concealed support members and simple downwardly removable access tiles that may be suspended from either a Z-bar or a T-bar support structure.

SUMMARY OF THE INVENTION

In accordance with the present invention, a suspended ceiling construction having concealed support members that is simple and easy to construct, yet provides easy access to the space above the ceiling, comprises a plurality of evenly spaced, coplanar, parallel support beams suspended from the ceiling, and a plurality of removable ceiling tiles suspended in rows between each pair of spaced first and second support beams.

Means releasably support one end of the ceiling tiles on the first support beam, each of the tiles having kerfs along opposite edges thereof extending between the first and second support beams. Spline means in the kerfs extend between adjacent tiles and engage the second support beam so that the tiles are supported at an opposite end through the spline. At least one of the tiles is an access tile and is removable downwardly. More specifically, splines in the kerf of adjacent tiles are relatively movable and inter-engagable. A locking means associated with one of the splines can be positioned in a slot associated with a tile adjacent to the locking means to secure the tile in the ceiling; and the locking means can be positioned in a vertical access in communication with the slot to remove the tile from the ceiling.

In one embodiment, at least one tile is cut away above the kerf along a portion of each side, thereby forming an opening above the kerf. The spline means adjacent the access tile includes a movable member slidable between a locking position engaging the kerf at the side of one tile and a release position at the cut away portion of the one tile. The movable member has a flange sized to pass through the opening when the movable member is in release position to permit the one tile to be removed from the ceiling when the movable members are moved to the release position at each side of the tile. The spline comprises an L-shaped flange which engages the second support means and projects into the kerf of the tile adjacent to the access tile. The movable member is slidably mounted on the L-shaped spline and has a laterally extending flange which extends into the kerf at the side of the access tile.

In another embodiment, a supporting spline means is within the kerf of the access tile and has an upwardly opening recess or indentation in communication with a horizontal slot. A locking spline means within the kerf of a tile adjacent the access tile includes a movable flange member slidable between a locking position engaging the slot of the supporting spline and a release position locating the flange at the vertical access and freeing the supporting spline. The flange member is sized to pass through the vertical access when the movable flange member is in release position to permit the one tile to be removed from the ceiling when the movable members are moved to the release position at each side of the tile.

The parallel support members can be the T-bar or Z-bar or L-shaped support structures. Preferably, the tiles have in the one end a kerf which receives a flange of the first support member. The tiles preferably have a lip at the opposite end which abuts and at least partially conceals the second support means.

One of the important advantages of the ceiling construction is that conventional or pre-existing Z-bar or T-bar support systems can be used, yet the ceiling has none of the drawbacks of Z-bar or T-bar systems. The support structures are fully concealed but are easily removable in a downward direction to provide maximum access to the space above the ceiling. Because the access tiles are removable downwardly, (in contrast with the upward access of conventional grid systems) the suspended ceiling of the present invention can be placed immediately adjacent to the structure or ductwork above the ceiling without impairing the removability of the tiles or access to the space above the tiles.

Another advantage of the ceiling construction of the present invention is that the vertical access or cutout can be located in either a tile or a spline. Thus, a user can choose between either specially fabricated splines or tiles. Generally speaking, the tiles and splines themselves are simple and inexpensive and easy to form, and the ceiling is easy to assemble and disassemble. The ceiling tiles may be formed of any conventional ceiling tile material and the various cuts and removed sections of the tiles are easily formed by conventional manufacturing methods. Likewise, the splines are relatively simple in construction. The support along the entire length of the tile sides prevents sagging of the tiles in the event of extreme moisture or heat, such as with a fire. In the embodiment where vertical access to a supporting slot is provided within a spline, the tiles need have no cutouts to remove the splines and need only relatively easily formed kerfs. The flanges and vertical accesses of the splines can be sufficiently narrow so only a relatively small amount of movement is required between the locking position and the release position. Such reduction of required movement is advantageous in reducing damage to tiles.

These and other advantages and features of the present invention will hereinafter appear and, for purposes of illustration, but not of limitation, a preferred embodiment of this invention is described in detail below.

DESCRIPTION OF PREFERRED EMBODIMENTS

Figure 1:
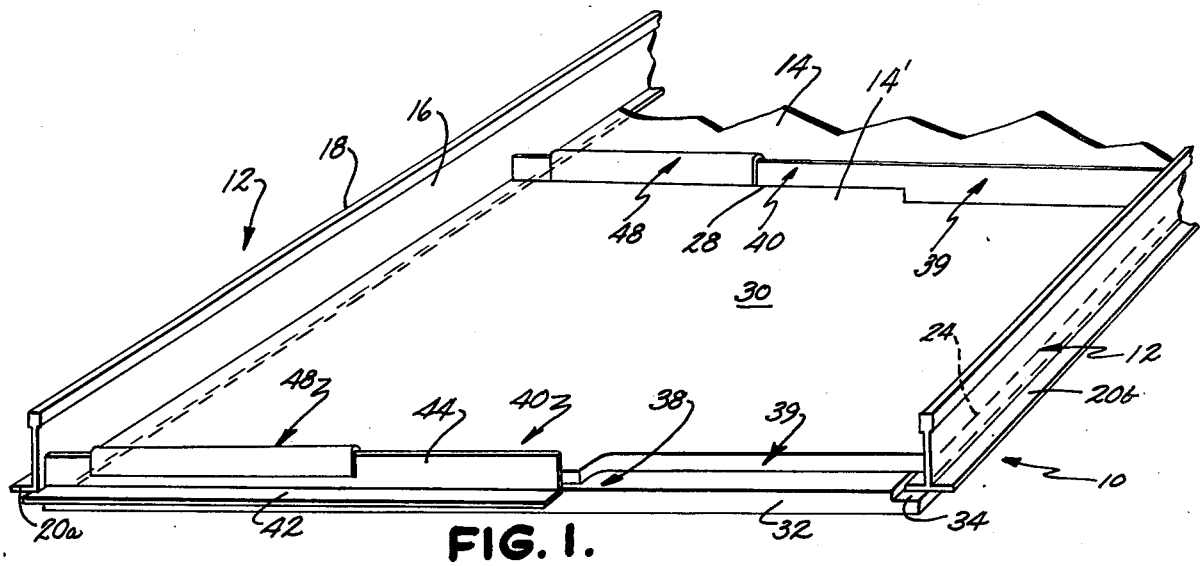
FIG. 1 is a broken perspective view of a section of the suspended ceiling construction of the present invention.

Referring now to the drawings, and to FIGS. 1–4 in particular, a suspended ceiling construction 10 comprises a plurality of inverted "T"-shaped parallel support beams 12 suspended from the structure in which the suspended ceiling is being mounted (e.g., from a fixed ceiling 11), and a plurality of removable ceiling tiles 14 suspended between adjacent parallel support beams. As shown in FIG. 1, ceiling tiles 14 are suspended between adjacent support beams in even rows. For purposes of illustration, a single row will be described herein, with the adjacent support beams being identified as a front support beam 12*a* and a rear support beam 12*b*. Similarly, reference to forward and rearward directions shall mean the left and right directions, respectively, as viewed in FIG. 3. The tiles are mounted in abutting relationship along the side edges thereof and extend from one side of the structure to the other. Each support beam 12 is formed of a rigid, lightweight metal and comprises a vertical support member 16 having an enlarged rectangular runner 18 at the top thereof and horizontal front and rear flanges 20*a* and 20*b*, respectively, extending laterally from each side of the bottom thereof.

Support beams 12 typically are suspended from the ceiling 11 by means of cables 22 which are fastened to the ceiling and pass through openings (not shown) in vertical support members 16. It should be recognized that there are any number of different methods for suspending support beams from structural members, and any of these methods would be satisfactory means for suspending the support beams of the present invention.

Ceiling tiles 14 are rectangular of square in shape and have a substantially flat back edge 24, the upper portion of which is relieved slightly to accommodate vertical member 16, a stepped or L-shaped front portion 26, and opposed side edges 28. Each tile comprises parallel flat top and bottom surfaces 30 and 32, respectively. Typically, in a T-bar construction, the tiles will be double tiles, as illustrated, that is, 2 feet long and 1 foot wide, while 1 foot square tiles (not shown) generally are used in Z-bar construction.

The back edge of each ceiling tile 14 is provided with a kerf or groove 34 between the top and bottom of the ceiling tile. This groove extends longitudinally the entire width of the tile and receives the front flange 20*a* of rear support beam 12*b*. The back edge 24 of ceiling tile 14 thus is releasably supported by support beam 12*b* and conceals front flange 20*a* from view.

The front portion 26 of ceiling tile 14 is L-shaped and comprises a lower lip or flange 36 that extends outwardly below rear flange 20*b* on front support beam 12*a*, thus concealing it from view. The ceiling tile is cut away and open above flange 20*b*, so that the ceiling tile requires an additional support to hold the front of the ceiling tile in place against the front support beam.

The sides of ceiling tile 14 are provided with longitudinal kerfs or grooves 38 that extend from the front portion of the tile rearwardly toward the back edge of the tile. Kerfs 38 are positioned in the sides of the tile above the top of lower lip 36 by a distance at least equal to the width of flange 20*b*. The kerfs could conceivably be placed at other elevations.

Figure 2:
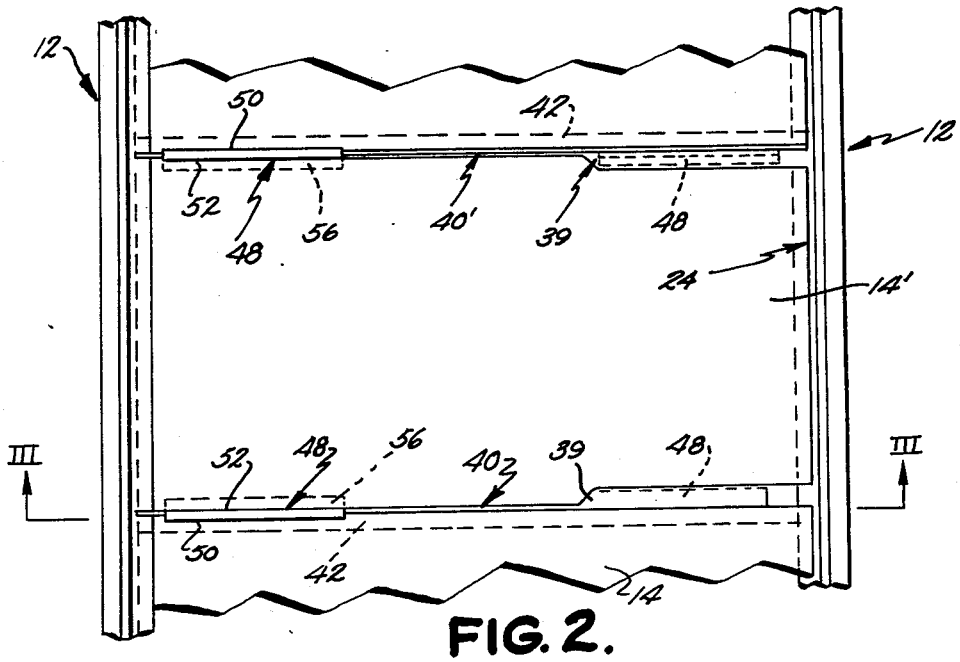
FIG. 2 is a top plan view of a portion of the suspended ceiling construction of the present invention.

As seen in FIGS. 1 and 2, the access tile 14' has a cutaway portion 39 communicating with kerf or slot 38 above the kerfs 38 at each side of the tile, thereby forming an opening or vertical access above each of the kerfs. The cutaway portions are shown along the back portion of the access tiles 14' and adjacent to the rear support beam 12*b*.

The tiles are supported at the front end adjacent to the front support beam 12*b* through spline means which extend into the kerfs 38 in each of the adjacent tiles and also supportingly engage the front beam 12*a*. In the embodiment illustrated in FIGS. 1–4, the spline means comprises an L-shaped spline 40 having a laterally extending lower portion 42 which projects into the horizontal slot or kerf 38 of each tile 14, an upright portion 44 and a longitudinal groove 46 along the length of the upright portion 44. One end of the L-shaped spline 40 extends over the front edge of the flange 20*b* of the front support member 12*a* and the other end extends back to the leading edge, but not over the flange 20*a* of the rear support beam 12*b*. If desirable, the L-shaped splines can extend partially over the flange 20*a* of the rear support beam 12*b* (as shown by spline 40' in FIG. 2).

A movable locking spline 48 is slidably mounted on the L-shaped spline 40 and includes an inverted guide flange 50, an upright portion 52 with an indentation 54, and a laterally extending portion 56. The indentation 54 fits within the longitudinal groove 46 of the spline 40 so that the locking flange 48 is slidably retained on the L-shaped spline 40. The laterally extending portion 56 of the locking spline 48 extends into the kerf 38 of the access tile 14'. The length of the laterally extending portion 46 is shorter than the length of the vertical access or cutaway portion 39 of the access tile 14' and has a width slightly greater than the kerf so that the portion 46 can be engaged by a disengaging tool.

Figure 3:
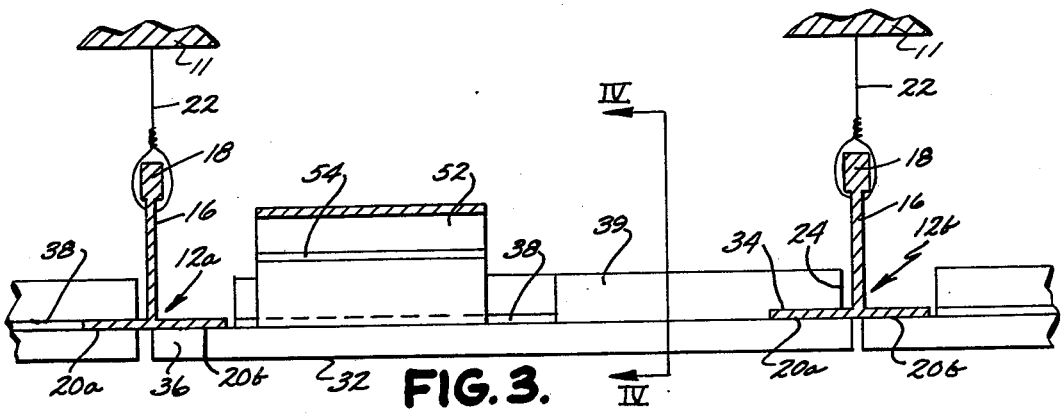
FIG. 3 is a broken sectional side view of the suspended ceiling construction of the present invention, showing the ceiling tiles suspended from a concealed grid support structure.
Figure 4:
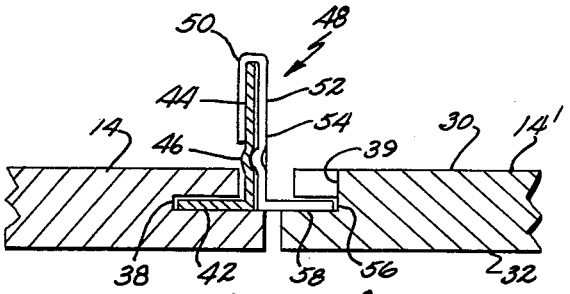
FIG. 4 is a partial sectional view taken along lines 4—4 of FIG. 3.
Figure 8:
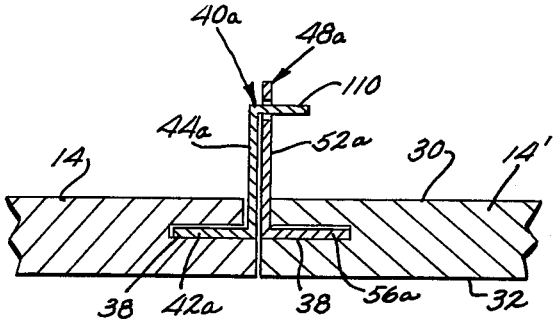
FIG. 8 is a partial sectional view taken along lines 8—8 of FIG. 7.

When the locking spline 48 is in the position illustrated in FIGS. 2 and 3, the access tile 14' is locked to the adjacent tile 14 through the locking spline 48. The access tile 14' and the adjacent tiles 14 are both supported at the front end by the front support beam 12*a* through the L-shaped spline 40 which fits over the flange 20*b* of the front support beam 12*a* and through the locking spline 48. The locking spline 48 is movable along the L-shaped spline 40 to a rear portion at which the laterally extending portion 56 of the locking spline 48 is positioned beneath the cutaway portion 39 of the access tile 14'. When each of the locking splines 48 is moved rearwardly adjacent the rear support beam 12*b* as illustrated in phantom lines in FIG. 2, the access tile will no longer be supported at the side and will drop, forward end first, from the ceiling. The access tile 14' is then gently pulled forward out of engagement with the rear support beam 12*b* and removed. The remainder of the tiles 14 in the line can then be removed merely by removing the L-shaped spline from engagement with the front support beam 12*a* and then sliding the tiles sideways into the open access space to disengage the sides of the tiles 14 from their engagement with the splines from opposite sides of the access opening. In this connection, it should be noted that the two L-shaped splines can be used in back-to-back relationships between two non-access tiles. Thus, the locking splines 48 are slidable from a locking position whereby the access tiles are supported through the spline means to a release position at the cutaway portions 39 of the access tiles 14' to permit the access tiles to be removed from the ceiling.

Reference is now made to FIGS. 5–8 for a description of the second embodiment of the invention. In this embodiment, like numerals have been used to designate like parts. Briefly, the tile construction of this embodiment is the same as that of the first embodiment except for the omission of cutaway portion 39. That is, kerf 38 is bounded by an upper flange 38*a* along the entire side of tile 14' and there is essentially no vertical access to kerf 38. Eliminating cutaway portion 39 is advantageous because a fabrication step is eliminated. For purposes of brevity, a further description of the tiles and the supporting structure will not be repeated herein.

Figure 5:
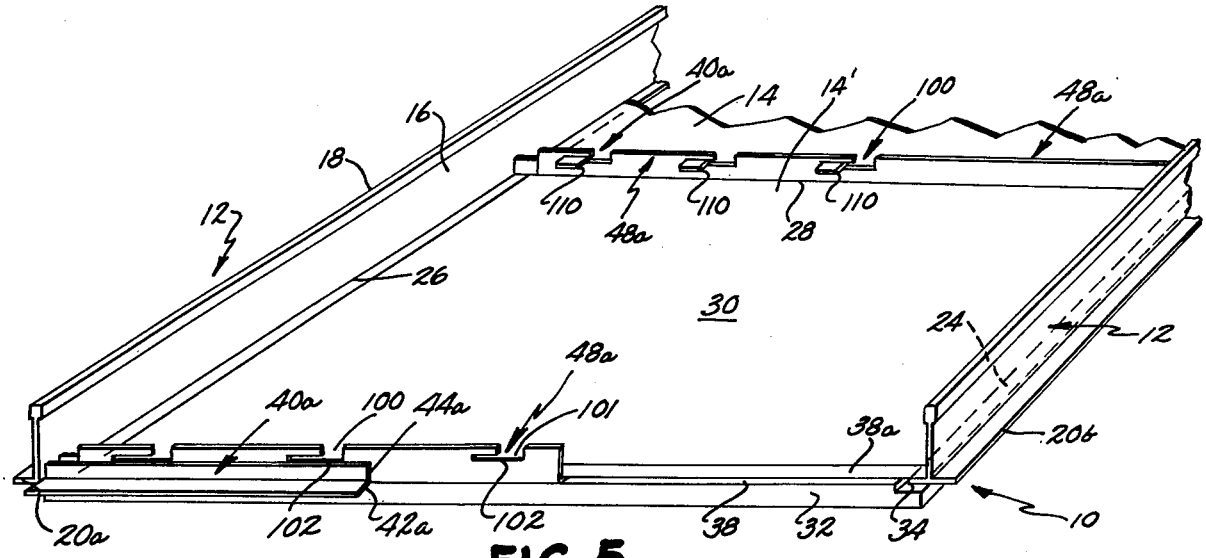
FIG. 5 is a broken perspective view like FIG. 1 but showing a second embodiment of the invention.
Figure 6:
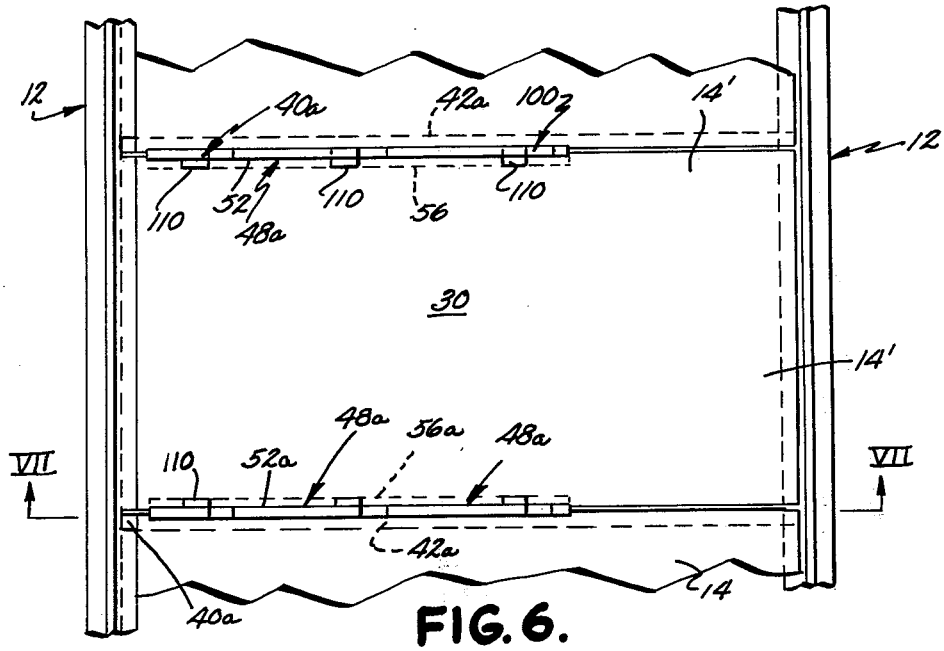
FIG. 6 is a top plan view like FIG. 2 but showing the embodiment of FIG. 5.

As seen in FIGS. 5 and 6, the access tile 14' has an elongated supporting spline 48*a* with openings 100 having an upwardly opening vertical access 101 in communication with a horizontal slot 102. Tiles 14 adjacent the sides of access tile 14' have an elongated locking spline 40*a* having horizontally extending flanges 110 of sufficiently small longitudinal length to be receivable within access 101.

The tiles are supported at the front end adjacent to the front support beam 12*b* through locking spline 40*a* which extends into the kerfs 38 in each of the adjacent tiles and also supportingly engages the front beam 12*a*. In the embodiment illustrated in FIGS. 5–8, the locking spline 40*a* comprises a generally L-shaped spline 40*a* having a laterally extending lower portion 42*a* which projects into the kerf 38 of each tile 14 (FIG. 8), an upright portion 44*a* and horizontal flanges 110 extending from the top of the top of upright portion 44*a* in a direction opposite from lower portion 42*a* and spaced periodically along the length of the upright portion 44*a*. In a locking position, one end of the L-shaped spline 40*a* extends over the front edge of the flange 20*b* of the front support member 12*a* and the other end extends back toward, but not over, the leading edge of the flange 20*a* of the rear support beam 12*b*. A typical length for spline 40*a* is about one-half the length of a side of tile 14.

Supporting spline 48*a*, mounted in a side kerf 38 of access tile 14', is configured to interlock with locking spline 40*a* and includes an upright portion 52*a* with openings 100, and a laterally extending portion 56*a*. As noted above, openings 100 include access 101 and slot 102 to receive flanges 110 of locking spline 40*a* so that locking spline 40*a* is slidably retained by support spline 48*a*. Slot 102 is vertically spaced downward from the top of supporting spline 48*a* so the portion of spline 48*a* above slot 102 can rest on flange 110 in the locking position. Advantageously, the length of supporting spline 48*a* is sufficient to support a substantial length of kerf 38 and so supporting spline 48*a* can extend over the front edge of flange 20*b* of the rear support beam 12*b*. The front of supporting spline 48*a* must clear the front edge of flange 20*b* of the front support member 12*a*. The longitudinal spacing of accesses 101 is chosen to coincide with the longitudinal spacing between flange 110.

Figure 7:
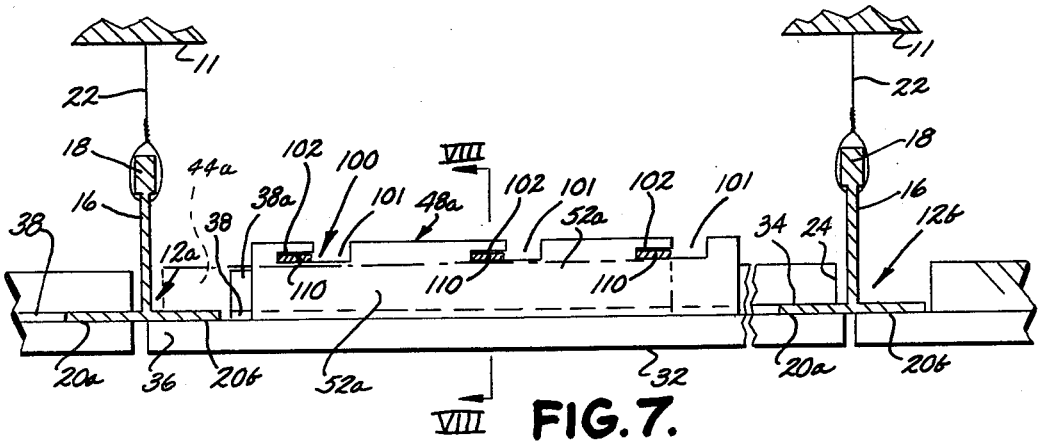
FIG. 7 is a broken sectional side view like FIG. 3 but showing the embodiment of FIG. 5.

When the locking spline 40*a* is in the position illustrated in FIGS. 6 and 7, the access tile 14' is locked to the adjacent tile 14 through the support spline 48*a*. The access tile 14' and the adjacent tiles 14 are both supported at the front end by the front support beam 12*a* through the locking spline 40*a* which fits over the flange 20*b* of the front support beam 12*a* and through the supporting spline 48*a*. When flange 110 of locking spline 40*a* is moved along slot 102 of opening 100 to access 101 at a rear portion of opening 100 flange 110 no longer restrains vertical downward movement of support spline 48*a*. When each of the locking splines 40*a*, on both sides of tile 14', is moved rearwardly toward the rear support beam 12*b*, the access tile will no longer be supported at the side and will drop, forward end first, from the ceiling. The access tile 14' is then gently pulled forward out of engagement with the rear support beam 12*b* and removed. The remainder of the tiles 14 in the line can then be removed merely by removing locking spline 40*a* from engagement, if any still exists, with the front support beam 12*a* and then sliding the tiles sideways into the open access space to disengage the sides of the tiles 14 from their engagement with the splines from opposite sides of the access opening. It is particularly advantageous that the distance locking spline 40*a* must be moved between a full release position and a full locking position in the width of flange 110. Such a small movement minimizes possible damage to the tiles. In summary, the locking splines 40*a* are slidable from a locking position whereby the access tiles are supported through the interlocking splines 40*a* and 48*a* to a release position wherein access 101 of the supporting spline 48*a* aligns with flange 101 of locking spline 40*a* to permit the access tiles to be removed from the ceiling.

Figure 9:
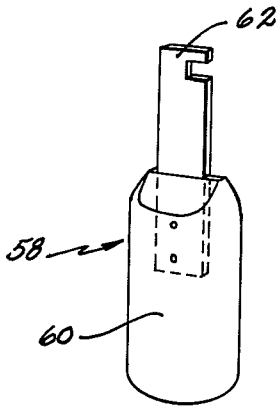
FIG. 9 is a perspective view of a disengaging tool employed with the suspended ceiling construction of the invention.

The movable splines in accordance with this invention are movable with a knife or any suitable tool which is inserted between access tile 14' and the adjacent tile 14. A suitable device for moving the splines is illustrated in FIG. 9 to which reference is now made. A disengaging tool 58 has a handle 60 with a hooked end 62 for engaging the front or back edge of the spline. If desirable the spline (e.g. 48) can have a slot (not shown) between the upright portion 52 and the laterally extending portion 56 for receiving the hooked end 62 of the disengaging tool 60.

In order to provide maximum ease of assembly and access to the space above the ceiling tiles, it is necessary that each row of tiles include at least one access tile, so as to permit free access to the space above the ceiling structure at any of the number of positions.

Whereas the invention has been described with reference to a T-bar grid support system, the invention is useful in other types of grid support systems. Such other grid support systems include the conventional Z-bar system.

Various modifications and variations will no doubt occur to those skilled in the art to which this invention pertains. For example, locking flanges can be coupled to the access tile and the slots with vertical access can be coupled to an adjacent tile and extended over the access tile. That is, the vertical access would open downwardly and pass the flange downwardly. Also, the particular shape of the flanges and the flange receiving openings may be varied from that disclosed herein. These and all other variations which rely on the teachings through which this disclosure has advanced the art are properly considered within the scope of this invention as defined by the appended claims.

The embodiments of this invention in which an exclusive property or privilege is claimed are defined as follows:

1. Components for a suspended ceiling construction comprising:

a ceiling tile;

a first spline means operatively associated with said ceiling tile for facilitating support of said ceiling tile;

a generally horizontal slot means for facilitating support of components of the suspended ceiling construction and a vertical access in communication with said slot means, said horizontal slot means being included in at least one of said ceiling tile and said first spline means;

a second spline means operatively associated with said ceiling tile and said first spline means for facilitating support of said ceiling tile, said second spline means having a support means adapted to be receivable within said slot means; and said first and second spline means being relatively movable with respect to each other between a support position and a release position; wherein in said support position said support means is positioned within said slot means thereby securing said ceiling tile to the suspended ceiling and wherein in said release position said support means is aligned within said vertical access thereby releasing said ceiling tile from the suspended ceiling.

2. Components for a suspended ceiling construction for buildings as receited in claim 1 wherein:

said support means includes a locking flange extending horizontally toward said ceiling tile;

said vertical access opens upwardly thus defining an upwardly opening recess;

said slot means including a horizontally elongated opening and a top member extending above and along at least a portion of said elongated opening; and said support position includes said locking flange at least partially positioned beneath said top member of said slot means thereby supporting said ceiling tile, and said release position includes said locking flange positioned within said upwardly opening vertical access thereby releasing said slot means for downward movement and facilitating removal of said ceiling tile from the suspended ceiling.

3. Components for a suspended ceiling construction as recited in claim 2 wherein:

said ceiling tile includes a first tile piece including a first horizontal kerf along an edge of said first tile piece and an adjacent second tile piece including a second horizontal kerf along an edge of said second tile piece, said second kerf facing said first kerf;

said first spline means has a lateral flange extending into and longitudinally along said first kerf and an integral, elongated, generally planar support body, said support body laterally extending generally perpendicular to said first kerf and including said upwardly opening recess in communication with said horizontally elongated opening, said opening extending into said support body and spaced from the top edge of said support body; and said second spline means extends longitudinally along said second kerf and includes an elongated, generally planar main body laterally extending generally perpendicular to said second kerf and an integral horizontal flange extending from said main body into said second kerf, said locking flange horizontally extending from said main body and being receivable by said recess and said horizontal slot.

4. A suspended ceiling construction for buildings comprising:

first and second parallel support beams suspended from a structural ceiling within the building;

a plurality of ceiling tiles suspended between said parallel support beams;

means for releasably supporting one end of said ceiling tiles on said first support beam;

said tiles having kerfs along opposite edges thereof extending between said first and second support beams; and interlocking spline means in said kerfs and extending between adjacent tiles, said spline means including a first member having a slot therethrough and a vertical access to at least a portion of said slot and a second member having a flange receivable within said slot; said first and second members being relatively slidable between a support position wherein said flange is vertically secured within said slot and a release position wherein said flange is positioned within said access, said flange being sized to move along said slot and to pass through said access when positioned in said release position to permit one tile to be removed from the ceiling when said first and second members are moved to the release position at each side of one tile.

5. A removable ceiling construction according to claim 4 wherein said first member has a plurality of longitudinally spaced slots, each slot being in communication with an associated access and extending in the same longitudinal direction from said associated access, and said second member has a plurality of protruding flanges, said flanges being spaced longitudinally along said second member to align with the accesses to said slots.

6. A suspended ceiling construction according to claim 4 wherein said tiles have a lip at an end opposite said one end, said lip abutting and concealing said second support means.

7. A suspended ceiling construction according to claim 5 wherein said first member includes an L-shaped flange with a bottom horizontal portion which projects into the kerf of a tile and a planar vertical portion having said upwardly opening access in communication with said slot; and said second member includes an L-shaped flange with a bottom horizontal portion which projects into the kerf of a tile and a planar vertical portion having laterally protruding flanges extending from said vertical portion in a direction opposite to said horizontal portion.

8. A suspended ceiling construction according to claim 7 wherein said second member of said spline means is positioned in the support position so as to overlap at least a portion of said second support beam thereby supporting the end of said ceiling tiles adjacent said second support beam; and is positioned in the release position to clear said second support beam thereby releasing the end of said ceiling tiles adjacent said second support beam and facilitating removal of said ceiling tiles from the ceiling.

9. A suspended ceiling construction according to claim 8 wherein said first member extends substantially along an entire side of a tile and clears said second support beam; and said second member is longitudinally shorter than said first member.

10. A suspended ceiling construction according to claim 9 wherein said first member extends over at least a portion of said first support beam.

11. A means for supporting a suspended tile ceiling on a hanger means including a plurality of support beams arranged parallel to each other with a plurality of ceiling tiles extending therebetween in abutting relationship comprising:

said ceiling tile including at least first and second ceiling tiles arranged adjacent each other with one edge of said first tile extending along and closely adjacent an edge of the second tile;

a first spline member engaging said first tile along said one edge and supported by said hanger means for supporting said first tile along said one edge thereof;

a second spline member engaging said second tile along said edge of said second tile;

said spline members being relatively slidable with respect to each other along the edges of said first and second ceiling tiles from a first position to a second position and having means in the first slidable position for causing simultaneous support of one of said spline members on the other of said spline members and also the support of said edge of said second tile by said first spline member to provide in said first position the support of said second tile by said first spline member; and means associated with said tiles and spline members for providing the release of the support of said second tile by said first spline member in response to the relative movement between said first and second spline members to said second slidable position.

12. The means for supporting tile ceiling as claimed in claim 11 in which the means associated with said tiles and splines for releasing said second tile from support by said first spline means includes an opening means in one of said tiles and splines, said opening means being aligned in said second position with at least a part of the means for causing simultaneous support engagement of said spline members and support of said second tile by said first spline member whereby in said second position the second tile can be lowered and removed for providing access to the space above it.

13. The means for supporting tile ceiling as claimed in claim 12 in which said second tile has a kerf along its said edge and a portion of said second spline is received within said kerf; said opening means being a cutout portion in the second tile along a portion of the length of said edge and above said kerf and the said portion of said second spline member received within said kerf is of a length less than the length of said cutout portion whereby in said first position the portion of said second spline member received within said kerf supports said second tile on said first tile and in said second position the said portion of said second spline member aligned with said cutout portion is released so that said second tile thereby releases the support of said second tile by said first spline member.

14. A means for supporting a suspended tile ceiling on a hanger means including a plurality of support beams arranged parallel to each other with a plurality of ceiling tiles extending therebetween in abutting relationship comprising:

said ceiling tiles including at least first and second ceiling tiles arranged adjacent each other with one edge of said first tile extending along and closely adjacent an edge of the second tile;

a first spline member engaging said first tile along said one edge and supported by said hanger means for supporting said first tile along said one edge thereof;

a second spline member engaging said second tile along said edge of said second tile;

said spline members being relatively slidable with respect to each other along the edges of said first and second ceiling tiles from a first position to a second position and having means in the first slidable position for causing simultaneous support of one of said spline members on the other of said spline members and also the support of said edge of said second tile by said first spline member to provide in said first position the support of said second tile by said first spline member;

means associated with said tiles and spline members for providing the release of the support of said second tile by said first spline member in response to the relative movement between said first and second spline members to said second slidable position, and including an opening means in one of said tiles and splines, said opening means being aligned in said second position with at least a part of the means for causing simultaneous support engagement of said spline members and support of said second tile by said first spline member whereby in said second position the second tile can be lowered and removed for providing access to the space above it;

said second tile having a kerf along its said edge and a portion of said second spline being receivable within said kerf; said opening means being a cutout portion in the second tile along a portion of the length of said edge and above said kerf and the said portion of said second spline member received within said kerf is of a length less than the length of said cutout portion whereby in said first position the portion of said second spline member received within said kerf supports said second tile on said first tile and in said second position the said portion of said second spline member aligned with said cutout portion is released so that said second tile thereby releases the support of said second tile by said first spline member; and said opening means being a cutout in the first spline member receiving at least a portion of said second spline member which provides for locking and release of said second spline member to said first spline member in response to a sliding action of said second spline member from said first position to said second position.

15. Ceiling tile for use in conjunction with a suspended ceiling construction including a plurality of ceiling tile arranged side by side between parallel support members which are hidden from sight by said tile substantially abutting adjacent tile along each edge thereof comprising:

a rectangular shaped tile of substantially greater length and width dimensions than thickness dimension;

said tile having a top surface, a bottom surface and parallel front and back edges and parallel side edges between said surfaces, said side edges and one of said front or back edges having kerfs extending along the length thereof and spaced from both of said top and bottom surfaces;

said other of said front or back edges having a flange located at the bottom surface thereby providing grooves located thereabove for receiving a support member; and an elongated cut-out in at least one of the side edges, said cut-out located above and extending a given distance along the kerf of said one side edge for receiving the entire length and a portion of the width of an elongated spline member.

* * * * *